United States Patent [19]

Sayers

[11] Patent Number: 4,780,065

[45] Date of Patent: Oct. 25, 1988

[54] CYLINDER PUMP HAVING AN AIR SENSOR ACTIVATED REVERSING VALVE

[76] Inventor: William Sayers, 129 S. Traymore Ave., Ivyland, Pa. 18974

[21] Appl. No.: 101,264

[22] Filed: Sep. 25, 1987

[51] Int. Cl.[4] ..... F04B 17/00; F01L 25/02

[52] U.S. Cl. ..... 417/403; 91/308

[58] Field of Search ..... 417/403, 401, 404; 91/305, 308, 306, 290, 319

[56] References Cited

U.S. PATENT DOCUMENTS

| | | | |
|---|---|---|---|
| 2,157,367 | 5/1939 | Warner et al. | 91/308 |
| 4,213,298 | 7/1980 | Milgram | 417/404 |
| 4,679,989 | 7/1987 | Harrman et al. | 417/403 |

*Primary Examiner*—Carlton R. Croyle
*Assistant Examiner*—Leonard P. Walnoha
*Attorney, Agent, or Firm*—H. Jay Spiegel

[57] ABSTRACT

The present invention relates to an improved cylinder pump. The cylinder pump includes air hoists enabling the entire pump assembly to be lifted so that a container may be placed thereunder and thereafter the air hoists may be biased downwardly so that the follower plate of the pump mechanism will bear down on top of the liquid contained within the container. Thereafter, the air cylinder of the pump is activated and reciprocated up and down through the provision of a four port reversing valve activated through the use of air sensors to cause the pump to pump fluid out of the container while the downward bias of the air hoists keeps the follower plate in contact with the surface of the liquid within the container. By separating the air cylinder actuator for the pump mechanism from the four port reversing valve thereof, improved reliability and quietness are attained.

3 Claims, 2 Drawing Sheets

CYLINDER PUMP HAVING AN AIR SENSOR ACTIVATED REVERSING VALVE

BACKGROUND OF THE INVENTION

In the prior art, pumps are well known and are used in various environments to pump various fluids from one location to another as desired. Examples of prior art pumps are taught by U.S. Pat. Nos. 3,945,768 to Georgi and 4,405,292 to Bixby Jr., et al as well as U.S. Pat. No. 4,477,232 to Mayer. Furthermore, pumps are made by the Alemite and Graco Company which include air hoists and a follower mechanism, however, these pumps are inferior to the teachings of the present invention as including an air motor head which combines a piston-cylinder with the control valves therefor in a single housing. This arrangement has been found by applicant to be troublesome and annoying in that the combined housing includes the outlet ports to atmosphere for the control valve and piston-cylinder and the control valve is quite noisy in conjunction with the annoying noises caused by the various ports. As such, a need has developed for a pump mechanism which separates the piston-cylinder from the control valve therefor to thereby reduce the noise levels in the vicinity of the pumping operation. Further in this regard, the specific mechanism built into the head of the prior art pump includes latches and springs to direct air internally thereof to control movements of the pistons in the cylinder. In operation, switching of the exhaust of air out of the various ports causes a snapping sound to occur which is extremely noisy and annoying. Thus, a need has developed for an improved pumping device which separates the control valve from the piston-cylinder so as to enable the reduction of annoying noises during the operation of the pump.

SUMMARY OF THE INVENTION

The present invention overcomes the deficiencies found in prior art pumps and provides a new and improved cylinder pump which comprises a vast improvement over prior art designs. The present invention includes the following inventive features:

(a) In a first aspect, the inventive cylinder pump includes a pair of air hoists which are designed to enable the selective lifting of the entire pump assembly to enable the placement of a container of liquid thereunder with the further provision of the ability to bias the air hoist downwardly to thereby cause the pump follower to engage the surface of the liquid within the container with a force bias.

(b) As inferred above, the pump assembly itself is mounted on a framework carried by the air hoists. The pump assembly includes an elongated cylindrical cylinder having a bottom inlet with the cylinder being mounted on a follower plate designed with a peripheral seal designed to ride in sealing engagement with the walls of the container, the fluid of which is to be pumped therefrom.

(c) An elongated piston rod with a piston at its lower end is slidably received within the elongated cylinder with the piston including a check valve designed to allow fluid to fill the cylinder above the piston during a downward stroke of the piston and to close and allow fluid above the piston to be pumped from the cylinder and out a discharge opening during upward movements of the piston rod and piston.

(d) The piston and rod are reciprocated up and down within the elongated cylinder by virtue of an air cylinder the movements of which are controlled by a four port reversing valve and air sensors. The air sensors comprise pilot devices which sense the position of the piston within the air cylinder and responsive to such sensing cause shifting of the four port reversing valve to result in reversal of the direction of movement of the piston within the air cylinder. It is important to note that the present invention separates, physically, the location of the four port reversing valve from the air cylinder housing to thereby enable the better control of the noises which naturally emanate from a four port reversing valve. In this regard, the vents on the four port reversing valve may be better muffled when it is contained in a separate housing not attached to the air cylinder housing.

Accordingly, it is the first object of the invention to provide an improved cylinder pump.

It is a further object of the invention to provide an improved cylinder pump having air hoists to lift the pump assembly and thereafter bias the follower plate thereof in engagement with a column of liquid contained within a container.

It is a further object of the invention to provide such a pump with an air cylinder actuator for the pump portion thereof having a control valve therefor physically separated from the air cylinder housing.

These and other objects, aspects and features of the present invention will be better understood from the following detailed description of the preferred embodiments when read in conjunction with the appended drawing figures.

SPECIFIC DESCRIPTION OF THE PREFERRED EMBODIMENT

Figure 1:
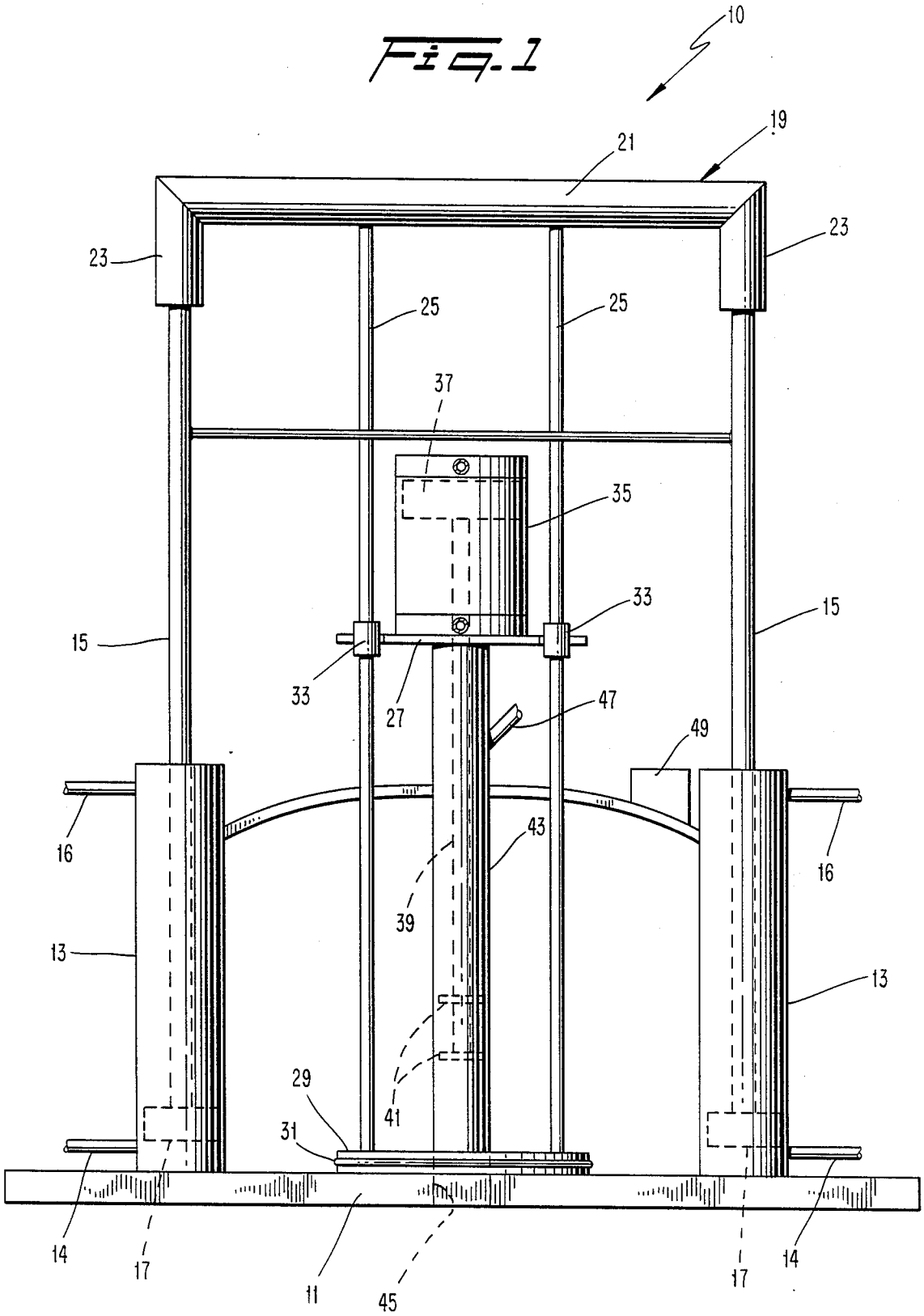
FIG. 1 shows an front view of the present invention.

With reference to FIG. 1, the inventive cylinder pump is generally designated by the reference numeral 10 and is seen to include a base 11 on which are mounted two elongated cylinders 13 each of which has slidably mounted therein a piston rod 15 carring a piston 17 having an outer periphery designed to be snuggly engaged with the internal surfaces of the cylinder 13.

The piston rods 15 are seen to extend upwardly and into attachment with a frame structure 19 which includes a horizontal frame member 21 having vertical attachment members 23 each of which attaches a respective piston rod 15 and wherein the horizontal frame member 21 has attached thereto elongated guideposts 25 which are maintained in spaced relation by a guidepiece 27 and extend downwardly into attachment with a follower plate 29 having a peripheral inflatable seal 31 mounted thereon for a purpose to be described in greater detail hereinafter.

The guideplate 27 is rigidly mounted to the guidepost 25 by virtue of collars 33 and the guideplate also provides a support for the air cylinder 35 which has contained therein a piston 37 having attached thereto elongated piston rod 39 having, at its distal end, a double piston head 41. The piston head 41 is seen to reciprocate within an elongated cylinder 43 which is mounted between the follower plate 29 and the guideplate 27.

The piston head 41 is seen to be slidably received within the internal walls of the cylinder 43 and the piston head 41 includes check valve structure (not shown) which is operative to allow fluid therepast during the downward stroke of the piston head 41 and to close on the upward stroke of the piston head 41 to thereby enable the pumping of fluid entering the bottom inlet 45 of the cylinder 43 out the discharge port 47 and to a point of desired use.

Figure 2:
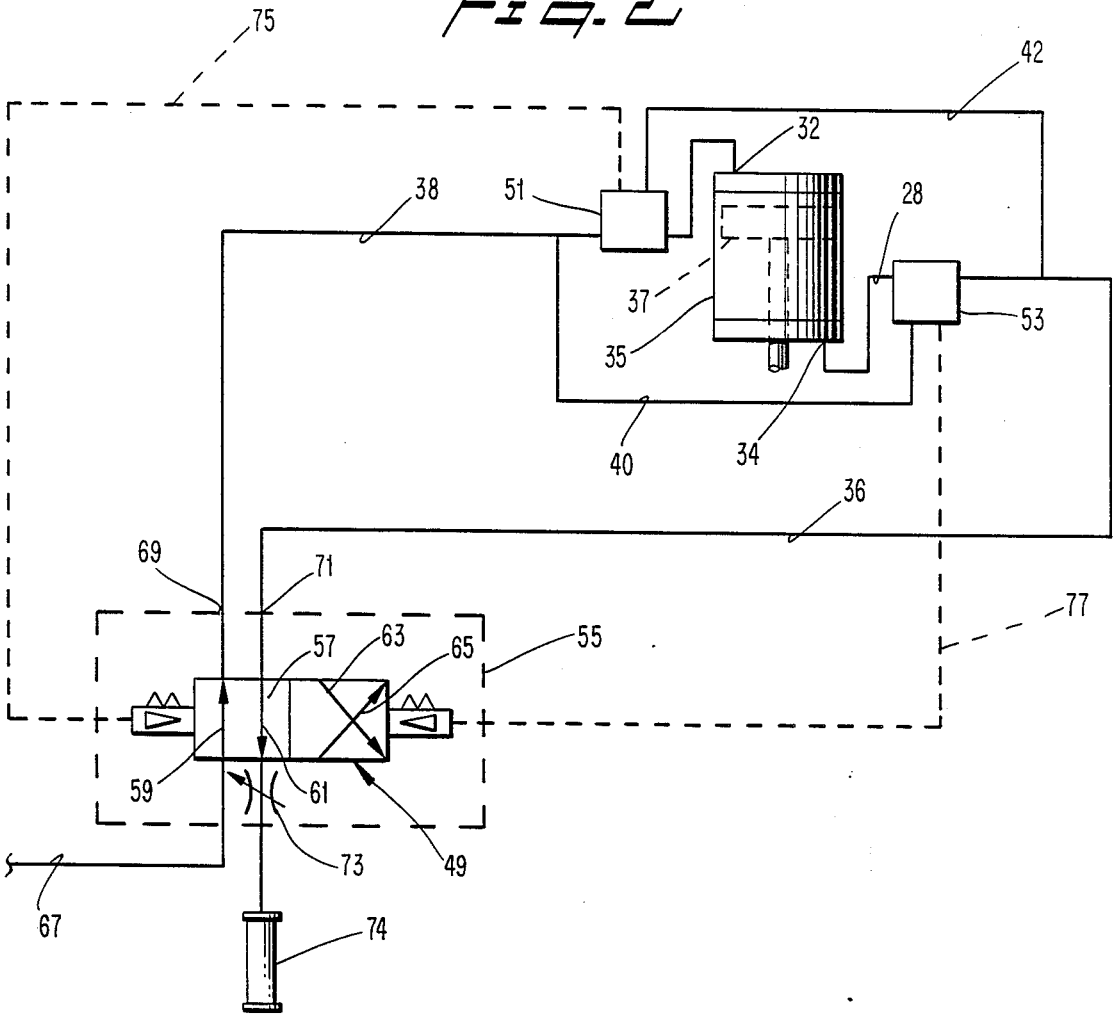
FIG. 2 shows an schematic diagram of the pneumatic circuit of the present invention.

With reference to FIGS. 1 and 2, movements of the piston 37 within the cylinder 35 are controlled by virtue of a directional control valve 49 known to those skilled in the art as a four port reversing valve. The control valve 49 is controlled by air sensors 51,53 (FIG. 2) which sense the position of the piston 37 within the cylinder 35 and responsive thereto cause shifting movements of the control valve 49.

With reference to FIG. 2, the control valve 49 includes a housing 55 in which a spool 57 is contained which spool includes passages 59,61,63 and 65 therethrough. As seen in FIG. 2, the passages 59 and 61 are parallel to one another whereas the passages 63 and 65 cross one another. The housing 55 includes a inlet port 67 connectible to a source of fluid pressure, an inlet-outlet port 69 substantially aligned with the inlet port 67, an outlet-inlet port 71 adjacent the inlet-outlet port 69 and an outlet port 73 comprising a restrictive orifice. As should be understood from FIG. 2, when the spool 57 is in the position shown the port 69 is the outlet port conveying fluid pressure from the port 67 via the passageway 59 in the spool 57 through the port 69 and to the cylinder 35 port 32 to cause downward movements of the piston 37 and the downward movements of the piston 37 will cause air flow out the port 34 via the passageway 36 to the port 71 of the valve 49, through the passageway 61 and out the restricted orifice outlet port 73. If, on the other hand, the spool 57 is shifted in the left-hand direction, then fluid pressure at the inlet port 67 will be conveyed via the spool passage 65 to the port 71 now an outlet port to thereby convey fluid pressure to the port 34 of the cylinder 35 to thereby cause upward movements of the piston 37 therewithin to thereby cause fluid pressure to pass out the port 32 and via the passage 38 to the valve 49 port 69 and via the spool passageway 63 to the restricted orifice outlet port 73.

As should be understood by those skilled in the art, the lines 75 and 77 are respective sensing lines which respectively connect with the air sensors 51,53 and which convey fluid pressure to the ends of the spool 57 to cause it to move in one direction or another. For example, with reference to the air sensor 51, with the spool in the position shown in FIG. 2, air pressure at the line 67 will be conveyed via the spool passage 59, the port 69 and the line 38 via the air sensor 51 to the port 32 to cause downward movements of the piston 37. Simultaneously, pressure in the line 38 is conveyed via the line 40 to the air sensor 53 but due to the pressure in the port 34 caused by downward movements of the piston 37, the sensor line 77 is kept disconnected from the line 40. When the piston 37 has reached the bottom of its travel, the pressure at the port 34 is lessened to zero thereby causing a diaphragm valve contained within the air sensor 53 to relax allowing interconnection of the lines 40 and 77 to thereby cause pressure therein to be seen on the right-hand side of the spool 57 thereby shifting the spool 57 in the left-hand direction to thereby cause reversing of the direction of flow of fluids through the system.

With the piston 37 in the downward position, and the valve spool 57 having been shifted leftward, fluid at the inlet port 67 will flow via the spool passageway 65 to the port 71 and line 36 through the air sensor 53 and to the port 34 to thereby cause the piston 37 to lift upwardly causing fluid pressure at the port 32 to pass through the air sensor 51, line 38 port 69 passageway 63 and outlet port 73.

Meanwhile, fluid pressure in the line 36 passes through the line 42 to the air sensor 51 but is prevented from fluidly connecting with the sensor lines 75 due to the diaphragm contained in the air sensor 51 which prevents such interconnection due to the pressure of fluid in the air sensor seen at the outlet port 32. When the piston 37 has reached its uppermost travel, pressure at the point 32 is reduced to zero thereby allowing the fluid pressure in the line 42 to pass by the diaphragm of the air sensor 51 and fluidly connect with the sensor line 75 to thereby cause right-hand movement of the spool 57 to thereby reverse the fluid flow paths.

Figure 3:
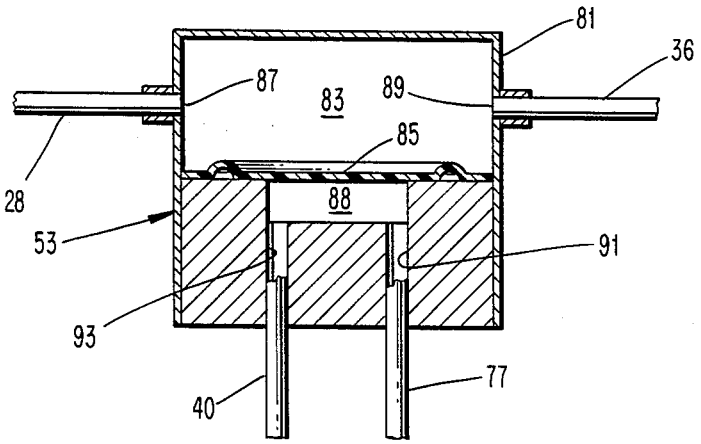
FIG. 3 shows a cross-sectional view through an air sensor valve in accordance with the teachings of the present invention.

With reference to FIG. 3, the air sensor 53 is seen to include a housing 81, a chamber 83, a diaphram 85 and a chamber 88. The housing 81 includes ports 87 and 89 and internal passageways 91 and 93 which terminate on opposed sides of the chamber 88 and which are prevented from communicating with one another due to the diaphragm 85 when there is a significant pressure within the chamber 83, but, which passageways 91,93 are allowed to communicate with one another through pressure in the lines themselves when pressure in the chamber 83 is reduced to zero.

The air sensor 51 is identical in construction to the air sensor 53. In the view of FIG. 3, to place the air sensors in perspective, the port 87 is connected to the passageway 28 shown in FIG. 2, the port 89 is connected to the passageway 36 shown in FIG. 2, the passageway 93 is connected to the passageway 40 and the passageway 91 is connected to the sensing line 77. As such, it should be understood that when the piston 37 is moving downwardly within the cylinder 35 and pressure is seen at the port 34 and line 28, that fluid passing through the chamber 83 and to the port 89 and outlet line 36 will cause the chamber 83 to become pressurized thereby causing downward bias on the diaphragm 85 to cause the diaphragm 85 to be bias against the outlets of the passageways 93 and 91 thereby preventing communications therebetween. On the other hand, when the piston 37 has completed its downward travel and the pressure at the port 34 and thereby in the chamber 83 has been reduced to zero, the downward bias on the diaphragm 85 is eliminated and pressure in the passageway 40 and the passageway 93 will cause upward movement of the diaphram 85 so that such fluid pressure may enter the passageway 91 and sensing line 77 to cause left-hand movement of the spool 57. From this, the operation of the air sensor 51 should be clearly understood.

It is an important aspect of the present invention that the four port reversing valve 49 is completely separate and apart from the cylinder 35 and in this way the valve 49 may be provided with speed reducing outlet structure 73 with muffler 74 to control speed of exhaust and noise and other noises which occur in prior art constructions when the air cylinder has incorporated therewith the reversing valve structure. Furthermore, the use of air sensors such as those designated by the reference numeral 51 and 53 instead of mechanical springs, latches and levers causes significant reduction in the noises which occur during the operation of the prior art valve structure.

With reference back to FIG. 1, it is seen that each air hoist includes two ports 14 and 16 which control upward and downward movements of the pistons 17 therein and thereby upward and downward movements of the frame 19 and attached pump mechanism.

In the operation of the present invention, when it is desired to pump fluid from a cylindrical container having an inside diameter equal to the outside diameter of the follower plate 29, the ports 14 are pressurized with fluid to thereby cause the lifting of the entire pump assembly, whereupon the cylindrical container may be placed in alignment underneath the follower plate 29 whereupon fluid pressure may be applied at the ports 16 to lower the follower plate 29 into the cylindrical container (not shown) whereupon the peripheral seal 31 of the follower 29 will sealingly engage the inner walls of the cylindrical container causing the inlet 45 to be fluidly connected with the fluid in the cylindrical container.

With the bias caused by air pressure at the ports 16 being maintained, the piston 37 may be activated in up and down movements responsive to control as explained hereinabove with reference to FIGS. 2 and 3 to thereby cause fluid to be pumped in the inlet 45 past the piston 41 via the check valve (not shown) and out the discharge point 47 to a point of use. During these pumping operations, as the level of fluid in the cylindrical container lowers, the air pressure at the ports 16 will cause lowering of the pistons 17 and thereby lowering of the follower plate 29 into the container to maintain contact of the underside of the follower plate with the surface of fluid within the cylindrical container. When the cylindrical container has been exhausted, fluid pressure may be placed on the inlet ports 14 to raise the pump assembly to a position where the cylindrical container may be removed from the base 11 and may be replaced with a further cylindrical container.

Accordingly, an invention has been described in terms of a preferred embodiment thereof which fulfills each and every one of the objects as set forth hereinabove and provides a new and improved cylinder pump assembly which is much quieter in operation than prior art designs and which has greater reliability in operation. Of course, various changes, modifications and alterations to teachings of the present invention may be contemplated by those skilled in the art without departing from the intended spirit and scope of the present invention. Accordingly, it is intended that the present invention only be limited by the terms of the appended claims.

I claim:

1. In a cylinder pump including a base, air hoist means mounted on said base, drive motor means mounted on said air hoist means, said drive motor means including a drive cylinder having reciprocably mounted therein a drive piston, a piston rod connected to said drive piston at a proximal end thereof and having attached at a distal end thereof a pumping piston mounted in a pumping cylinder, the improvement comprising:

(a) a four port reversing valve operatively connected to said drive motor means, said four port reversing valve being mounted in a location remote from said drive motor means;

(b) air sensor means connected between said drive motor means and said four port reversing valve for sensing the position of said drive piston and, responsive thereto, switching the positon of said four port reversing valve, said air sensor means comprising a first air sensor and a second air sensor, each said air sensor comprising:

(1) a housing including a diaphragm dividing said housing into a first chamber and a second chamber;

(2) said first chamber including an input port and an output port;

(3) said second chamber including an inlet and an outlet, said diaphragm preventing fluid communication between said inlet and outlet in a first position thereof and allowing fluid communication between said inlet and outlet in a second postion thereof.

2. The invention of claim 1, further including a first port at one end of said drive cylinder and a second port at another end of said drive cylinder, said iirst and second ports being alternately supplied with fluid under pressure via two supply lines of a fluid circuit from said four port reversing valve to reciprocate said drive piston back and forth, each air sensor being interconnected into said fluid circuit with a respective supply line connected across a said input port and . outlet port.

3. The invention of claim 2, further wherein said four port reversing valve is shifted back and forth by fluid pressure conveyed through two sensing lines supplied with fluid pressure from said fluid circuit, each said sensing line being connected to said fluid circuit via a respective air sensor second chamber inlet and outlet.

* * * * *